US006694686B2

(12) United States Patent
Ready et al.

(10) Patent No.: US 6,694,686 B2
(45) Date of Patent: Feb. 24, 2004

(54) DECK PROTECTION SYSTEM

(75) Inventors: Kenneth W. Ready, Lonetree, CO (US); Stephen M. Smyth, Highlands Ranch, CO (US)

(73) Assignee: Dri-Deck Enterprises, LLC, Lonetree, CO (US)

( * ) Notice: Subject to any disclaimer, the term of this patent is extended or adjusted under 35 U.S.C. 154(b) by 0 days.

(21) Appl. No.: 10/003,692

(22) Filed: Oct. 24, 2001

(65) Prior Publication Data

US 2003/0074850 A1 Apr. 24, 2003

(51) Int. Cl.[7] ..... E04F 17/08
(52) U.S. Cl. ..... 52/302.1
(58) Field of Search ..... 52/11, 16, 302.1, 52/302.3

(56) References Cited

U.S. PATENT DOCUMENTS

| | | | | |
|---|---|---|---|---|
| 135,044 A | | 1/1873 | Morden | |
| 612,024 A | | 10/1898 | Drake | |
| 956,372 A | * | 4/1910 | Kreutzberg | 210/460 |
| 4,065,883 A | | 1/1978 | Thibodeau | |
| 4,129,967 A | | 12/1978 | Barlow | |
| 4,373,315 A | * | 2/1983 | Farrant | 352/522 |
| 4,663,894 A | | 5/1987 | LaRoche et al. | |
| 4,860,502 A | | 8/1989 | Mickelsen et al. | |
| 5,195,281 A | | 3/1993 | Kosko | |
| 5,511,351 A | | 4/1996 | Moore | |
| 5,678,359 A | * | 10/1997 | Turner | 52/12 |
| 5,765,328 A | | 6/1998 | Moore | |
| 6,164,019 A | | 12/2000 | Salley | |
| 6,167,717 B1 | | 1/2001 | Dudley et al. | |
| 6,212,837 B1 | | 4/2001 | Davis et al. | |
| 6,226,941 B1 | | 5/2001 | Stevens | |
| 6,226,956 B1 | | 5/2001 | Davis et al. | |
| 6,244,007 B1 | * | 6/2001 | Heikkila | 52/302.3 |
| 6,279,271 B1 | * | 8/2001 | Burkart, Jr. | 52/11 |
| 6,308,479 B1 | * | 10/2001 | Prohofsky | 52/302.1 |
| 6,343,450 B1 | * | 2/2002 | Vance, Jr. | 52/302.1 |
| 6,385,931 B1 | * | 5/2002 | Risser | 52/302.1 |
| 6,393,785 B1 | * | 5/2002 | Burt | 52/302.3 |
| 6,415,571 B2 | * | 7/2002 | Risser | 52/302.1 |

OTHER PUBLICATIONS http://www.americandrydeck.com/, 4 pages first posted Oct. 20, 2001.* http://www.dekdrain.com/, 4 pages first posted May 28, 2002.*

Product Photos, Southridge Builders, Inc. of Littleton, Colorado, Deck drain system sold and installed 1998 (8 pages).

"Frequently Asked Questions," Dry–B–Lo International, Inc., Jun. 28, 2001, 2 pages http://www.dry–b–lo.com/faq.html [Accessed Jun. 28, 2001].

* cited by examiner

*Primary Examiner*—Robert Canfield
(74) *Attorney, Agent, or Firm*—Perkins Coie LLP

(57) ABSTRACT

Various embodiments of the present invention provide deck protection systems for use with a deck structure, including planks and support structures. One embodiment provides a body having a deep end, shallow end, a trough section, and opposing side edges. The opposing side edges support the deck protection system between two parallel support structures, and water falling between the planks is captured by the trough and flows from the shallow region to the deep region to an exit located in the deep region. The water passes through the exit and a spout, preventing water from touching the supporting structures and preventing water from falling directly below the deck.

25 Claims, 7 Drawing Sheets

DECK PROTECTION SYSTEM

TECHNICAL FIELD

The present invention generally relates to a deck protection system and has particular utility as a device to protect the underside of a deck from accumulation of moisture and to channel water away from a deck to keep the area underneath the deck dry.

BACKGROUND

Conventional decks are known. Wooden decks are typically constructed using a series of parallel joists that support a plurality of wooden planks or boards. The planks are placed side by side, typically about one-eighth of an inch (⅛") apart, and are placed perpendicular to and on top of the joists. Sometimes the planks may be placed at an acute angle to the joists. In all of these cases, the joists support the planks and provide the main structure of the deck. The planks may be fastened to the joists via screws, nails, or other connection devices. These decks are often placed adjacent to a building, such as a house, to provide an elevated area above the ground that is easily accessible by the homeowners. When placed next to a building, the deck may also be fastened to a wall of the building for additional support.

One problem with conventional decks is that water, such as rainwater, will leak through the gaps between the planks, causing the water to fall in the area below the deck. This will eventually lead to rotting due to accumulation of moisture on the underside of the deck. The lifespan of a conventional deck is usually limited by rotting of its component wood, which is accelerated by moisture that accumulates on the underside of the deck. The underside of the deck includes the areas of the deck materials (e.g., planks and support structures) that are not visible from above the deck, such as the underside of the planks and the side of the joist facing the interior of the deck. This problem exists because moisture on the inside of a deck will not dry quickly as it is not exposed to sunlight, winds, etc., as is the outer surface of a deck.

Recently, more and more buildings, particularly houses, are being constructed with multiple decks. The multiple decks are often placed above each other. The leaking problem described above is exacerbated when there is another deck below the first deck, because the water will fall onto the lower deck. In that situation, the lower deck area cannot function as usable living space during or shortly after a rainstorm as water will leak onto the lower deck. After a snowstorm, the problem can be even worse, since water will leak through for days as the accumulated snow on an upper deck slowly melts.

The current state of the art to deal with these problems is a metal attachment that is placed underneath the deck, as constructed by companies such as Dry-B-Lo (http://www.dry-b-lo.com). In this solution, a repeating series of metal curvilinear sections are attached to the underside of the joists to catch water dripping between the cracks in the deck, where the metal curvilinear sections hang well below the underside of the joists. A gutter system is attached on one end of the metal curvilinear sections to channel the water collected within the sections. This system is expensive, difficult and time-consuming to install. Often, a certified installer must install this system. Moreover, such an attachment hanging below the deck is aesthetically unpleasant. In addition, while it does prevent water from dripping directly below the deck, it does not prevent the accumulation of moisture on the inside of the deck, and therefore may encourage rotting because it hinders air flow.

SUMMARY

Various embodiments of the present invention provide deck protection systems. One embodiment includes a deck protection component to be installed between joists in a deck structure, where the deck structure includes a plurality of parallel joists and a plurality of planks placed on top of the joists. The deck protection component comprises a body having a trough section, a deep region, a shallow region, and opposing side edges. In one embodiment, the trough section is concave and the deck protection component further comprises an exit and a spout located at the deep region. Water falls between adjacent planks and into the body, where it then flows towards the deep end. After reaching the deep region, the water flows out of the exit and spout and away from the area beneath the deck.

The various embodiments of the present invention greatly reduces, and may even prevent, moisture collection on the inside of and the underside of a deck during a rainstorm, minimizing, delaying, or even preventing rotting of the component wood. Moreover, the various embodiments of the present invention direct water away from the area beneath the deck to a more desirable location, allowing the area beneath the deck to remain dry. At least one embodiment of the deck protection system, which includes one or more deck protection components, is generally less expensive, provides more efficient and effective protection, and is easier to install than known prior art systems.

Figure 1:
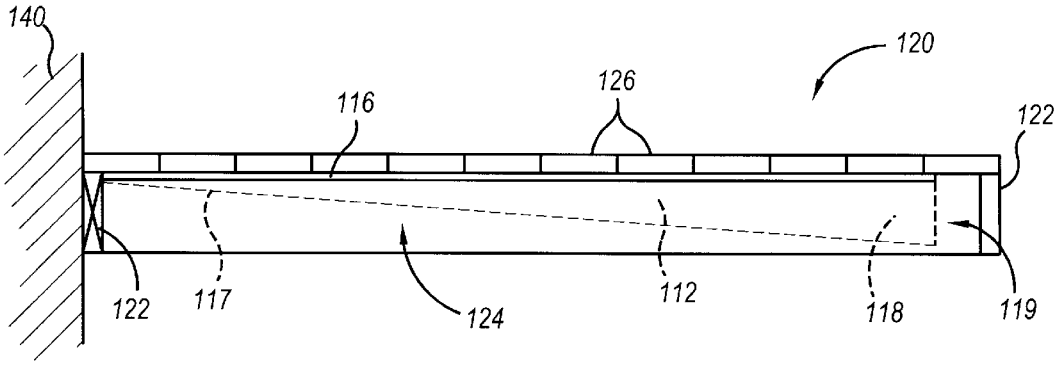
FIG. 1 is a cross-sectional side view of a deck protection component in one embodiment of the present invention.

Note: the headings provided herein are for convenience and do not necessarily affect the scope or interpretation of the invention.

DETAILED DESCRIPTION

Various embodiments of the present invention provide deck protection systems, including deck protection components. The following description provides specific details of certain embodiments of the invention illustrated in the drawings to provide a thorough understanding of those embodiments. It should be recognized, however, that the present invention can be reflected in additional embodiments and the invention may be practiced without some of the details in the following description. In other instances, well-known structures and functions have not been shown or described in detail to avoid unnecessarily obscuring the description of the embodiments of the invention.

Figure 2:
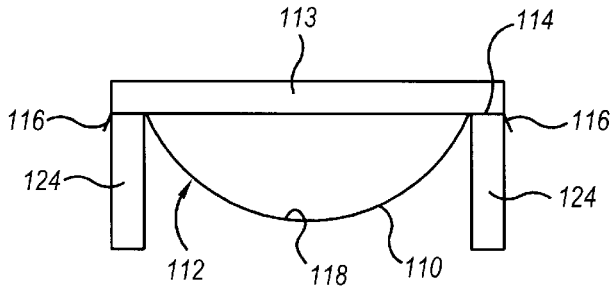
FIG. 2 is a cross-sectional front view of the deck protection component of FIG. 1.
Figure 3:
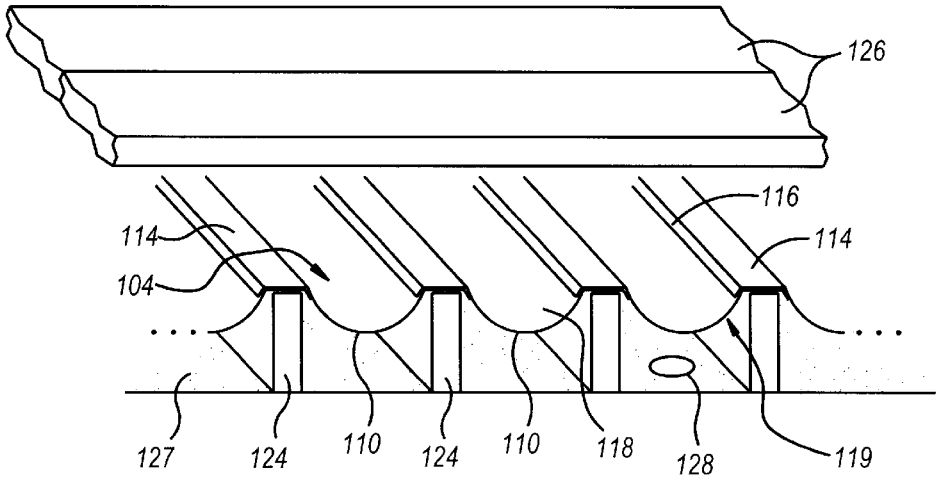
FIG. 3 is a schematic isometric view of a deck protection system installed in a deck using the deck protection components of FIGS. 1 and 2.

FIGS. 1–3 depict one embodiment of a deck protection component 110 of the present invention installed in a deck 120. Referring first to FIG. 1, support structures such as ledgers 122 are used to provide support for the deck. In the depicted embodiment, the ledgers 122 are two inch by six inch (2"×6") wooden boards. Support structures such as joists 124 are placed perpendicular to the ledgers 122 and attached thereto by a connection device such as a series of nails, screws, etc. The ledgers 122 structurally support the joists 124 at particular distances from each other. Ledgers 122 may be attached to a building, supported from below, resting on the ground, etc. The joists 124 are typically placed twelve (12) to sixteen (16) inches apart from each other and placed substantially parallel to each other, and are two inch by six inch (2"×6") wooden boards in the depicted embodiment. Planks 126 are placed on top of the joists 124 and the ledgers 122, with the planks 126 being perpendicular to the joists 124 and parallel with the ledgers 122. In other embodiments, the planks 126 may be located at an acute angle to the joists 124. The planks 126 may be attached to the joists 124 and ledgers 122 via screws, nails or other connection devices. Adjacent planks 126 may be located a suitable distance apart, and may be between one-sixteenth (1/16) of an inch and two (2) inches apart, and may even touch in some places. In the depicted embodiment, the planks 126 are also two inch by six inch (2"×6") wooden boards. The joists 124 and ledgers 122 provide the support for the planks 126, which are typically the top of the deck 120 which people may walk upon.

In the depicted embodiment, one ledger 122 abuts a building 140, such as a house, office building, etc. In this embodiment, one plank 126 will also abut or be located relatively close to the building 140, permitting the deck 120 to substantially abut the building 140.

Referring to FIGS. 1–2, the deck protection component 110 is located in the area formed in between adjacent joists 124. The deck protection component 110 is also located substantially underneath the planks 126 and substantially between opposing ledgers 122. In the depicted embodiment, the deck protection component 110 has a body with a trough 112 bordered by opposing side edges on its longitudinal edges. The trough 112 may be any suitable shape, such as a curved section, a semi-circular section, a squared-off section, a V-shaped section, etc. The trough 112 may be concave to receive water therein and direct the water to flow along the bottom of or along a longitudinal centerline of the trough 112 rather than flow down the joists 124 and ledgers 122. In one embodiment, the depth of the trough 112 is sized to be smaller than the depth of the joist 124, so that the deck protection component 110 will not protrude below the joist 124 when installed. In the depicted embodiment, the deck protection component 110 is five inches (5") deep, which is less than the six inch (6") depth of the joist 124. In other embodiments, any depth may be used, such as a more shallow depth such as two inches. The trough 112 may provide efficient flow of water, simplify manufacture and distribution, and help eliminate stoppages caused by debris. For example, a curved trough 112 will assist in keeping the device clear of obstructions (e.g., pine needles, leaves, etc.). Any obstructions will collect at the bottom of the component 110, which is also where water will flow, and running water will act to flush obstructions out of the deck protection component 110.

The deck protection component 110 also has a flange 114 located on each side, where the flanges 114 may be located on opposing side edges. The flange 114 is preferably sized to sit over the joist 124 to support the deck protection component 110. The flange 114 may also assist in preventing water from reaching components of the deck 120. In the depicted embodiment, the flange 114 is one-half inch (½") longer than the joist 124, so that a turn down 116 can be created to assist in the waterproof or water-resistant environment (best illustrated in FIG. 2).

When the maximum depth of the deck protection component 110 is less than the height of the joist 124, the deck protection component 110 will not be easily visible from outside the deck unless the viewer is directly below the deck, providing an aesthetically pleasing solution. In one alternative embodiment, a cover 127 (which may be formed of drywall or the like) can be attached to the bottoms of the joists 124 to ensure that the deck protection components 110 are not visible from anywhere outside of the deck. In this embodiment, an escape 128 in the cover 127 would be necessary to drain the water to its ultimate destination. In this embodiment, water could escape from the cover 127 into a gutter system (not shown) that may direct the flow of water to a more convenient location. A venting system, such as small holes in the cover 127, may be used to help prevent rotting of the deck.

The deck protection component 110 also changes depth throughout its length (also known as being pitched), as can be seen in FIG. 1. In the depicted embodiment, the deck protection component 110 starts off relatively shallow, such as one inch (1") deep, at a shallow region 117. The shallow region 117 is usually placed adjacent to the wall of a building, but could be located anywhere in the deck protection component 110. In the depicted embodiment, the deck protection component 110 gradually becomes deeper (i.e., tapers, slopes, etc.) until it reaches its maximum depth at a deep region 118, which is spaced from the shallow region 117 and may be located at one end of the trough 112 opposite the shallow region 117. The variable depth facilitates flow of water from one region of the deck protection component 110 to the other. The deck protection component 110 also has an exit 119, which allows water to flow out of the deck protection component 110 when installed normally. The exit 119 is preferably located at or near the deep region 118 of the deck protection component 110, but other embodiments (not shown) are possible, such as an exit 119 located in a deep region 118 located near the center of the trough 112, with shallow regions 117 located near the ends of the trough 112 that direct water towards the deep region 118.

The deck protection component 110 may also contain a flare 113 near one end. The flare 113 may be located near the shallow region 117 at the end of the deck protection component 110 that will be located next to a building 140. The flare 113 is preferably installed flush with the building 140, so that any water falling into the gap between the building 140 and the plank 126 is directed down the flare 113 into the trough 112 or shallow region 117, where it will ultimately flow through the exit 119. One skilled in the art will recognize that many options exist for the flare 113, including different shapes, materials, and an entirely separate or detachable piece. In another embodiment, caulking is used between the building 140 and the flare 113 to provide additional protection from water leakage. In yet another alternative embodiment, caulking is used instead of a flare 113 to provide some protection from water leakage.

In one embodiment, the deck protection component 110 is constructed of a thin polyethylene between 5/1000 of an inch and 30/1000 of an inch (0.005"–0.030") thick. A thin polyethylene is inexpensive, easy to manufacture, easy to fold or crease, can be easily cut with scissors, and water impermeable. One of ordinary skill in the art will recognize that any material could be suitable for construction of the deck protection system component 110, such as other plastics, different thicknesses of polyethylene, polypropylene, Mylar, metal, wood, recycled material, ceramics, etc. If the material was thin and flexible enough, the deck protection component 110 could be rolled, allowing for more efficient delivery and marketing of the product.

In one embodiment, the deck protection component 110 may be injection molded or vacuum molded plastic. Injection molding requires a higher up-front cost as a mold needs to be created, but the cost of producing the products is relatively low. Vacuum molding requires less up-front costs than injection molding, but the cost of producing individual products is higher. Injection molding also provides more flexibility in creating deck protection components 110 with different shapes. One skilled in the art will recognize that many alternatives for manufacturing the deck protection components 110 are possible and within the scope of the invention.

Deck protection components 110 may be easily installed by a purchaser during the construction of a deck. Individual deck protection components 110 are simply placed in the space between the joists 124 and ledgers 122 before the planks 126 are placed down. In one alternative embodiment, the deck protection component 110 must be unrolled first before installation. The purchaser may align the deck protection component 110 such that the shallow region 117 is near the building 140, for example, and such that the flanges 114 rest on top of the joists 124. Adjacent deck protection components 110 may have flanges 114 that rest on top of each other. The deck protection component 110 may need to be squeezed by the purchaser in order to fit between two joists 124. The amount of squeezing required will affect the depth of the deck protection component 110. For example, if two joists 124 were relatively close together, the edges of the deck protection component 110 could be squeezed together so that the deck protection component 110 would fit between the joists. This would result in the curve of the trough 112 becoming deeper and for the deck protection component 110 to hang deeper between the joists 124 (and to have a larger depth). This flexibility allows one design of deck protection component 110 to be used for a wide variety of decks.

After placement of the deck protection components 110, the planks 126 may be laid on and securably attached to the deck, often perpendicular to or at an acute angle to the joists 124. Any screws or nails used to attach the planks 124 to the joists 124 may also secure the deck protection components 110, as will the weight of the planks 126 themselves. A gutter or similar device (not shown) may be placed under an exit 119 to facilitate more precise placement of exiting water. The deck protection components 110 could be attached to the bottom of an existing deck, but some of the benefits of the system may not be fully realized. In another embodiment, the deck protection component 110 may be installed in a pre-existing deck simply by removing the planks 126, installing the components 110, and reattaching the planks 126.

FIG. 3 is a schematic isometric view of a deck protection system installed in a deck using the deck protection components 110 of FIGS. 1 and 2. As illustrated in FIG. 3, a series of parallel joists 124 provide the primary support for the deck. A deck protection component 110 is placed in between each pair of adjacent joists 124. The flanges 114 on each protection system 104 are placed over each joist 124, resulting in two flanges 114 being located on top of each internal joist 124 (because of two different adjacent deck protection components 110). However, only one flange 114 would be located on top of the joists 124 at the edges of the deck 120 since only one deck protection component 110 would be involved. This overlap of the flanges 114 may define a more tortuous pathway water would have to follow to contact the joist, further reducing the likelihood that the joist will become wet and rot. Planks 126 are then placed on top of (and possibly perpendicular to) the deck protection components 110 and joists 124. If the planks 126 are screwed or nailed to the joists 124, the screws or nails will pierce the flanges 114 of the deck protection components 110 and be securably mounted in the joists 124. When rain or other water lands on the deck, the water will flow through the gaps between adjacent planks 126. The water will be caught by the deck protection components 110, which run the entire length of the joists 124 towards the deep region 118 of the deck protection component 110 and out of the exit 119. The double flanges 114 located at each joist 124 and the optional turn downs 116 provide additional waterproofing. Because of the variable depth of the deck protection components 110, the water will flow toward the deep region 118 of the deck protection component 110 and will escape through an exit 119.

A myriad of exit 119 options exist, including any sort of hole (e.g., any suitable size, shape, location, etc.), any number of holes, a permeable material that allows water to escape, or any combination thereof. In one embodiment, the exit 119 is simply an open end of the deck protection component 110, allowing water to flow out the end. In another embodiment, a gutter is located at the end of the deck protection component 110 or underneath an exit 119 so that water can be directed by the gutter to a more desirable location. In yet another embodiment, the exit 119 (and shallowest point) is located near the center of the deck protection component 110, allowing water to flow downward from both ends through the exit 119.

The depicted embodiment will prevent moisture from accumulating underneath a deck. The deck protection component 110 provides a protective environment for water dropping through the planks 126, keeping the inner surface of the joists 124 and ledgers 122 essentially dry. Moreover, water is directed away from the area below the deck 120, preserving that area as usable space during or after rain or snowstorms.

In one alternative embodiment, the deck protection system may be used with other structures besides decks. For example, the deck protection components 110 may be placed in the roof of a barn, storage shed, gazebo, etc. to provide an area below the roof that does not get wet during rainstorms. The deck protection components 110 can therefore be used as a low-cost and easy to install water protection system for a wide variety of structures.

Figure 4:
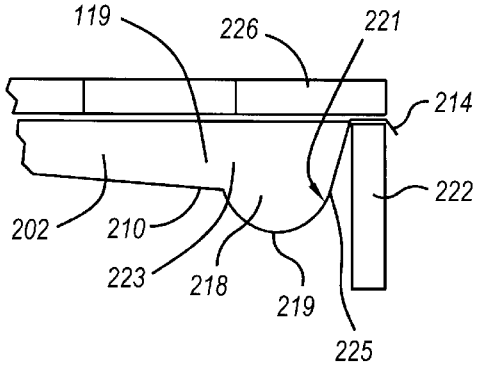
FIG. 4 is a schematic side view of the deep region of a deck protection component in a first alternative embodiment of the invention.

FIG. 4 is a schematic side view of the deep region 218 of a deck protection component 210 in a first alternative embodiment of the invention. In FIG. 4 it can be seen that the deep region 218 of the deck protection component 210 is in an end portion 221 having a deep concave shape, which will assist in preventing overflows of water, provides ease of manufacture, and helps prevent blockages from debris. The deck protection component has the trough portion 202 with the exit 119 in fluid communication with an entrance 223 of the end portion 221. The end portion 221 has an end wall 225 opposite the entrance 223. In the illustrated embodiment, the end portion 221 is integrally connected to the trough portion 202 and it spans between the joists 124. The deep region 218 in the end portion 221 includes an exit 219 located at the bottom of the deep concave shape. The concave shape protects the ledger 222 from moisture. A flange 214 can also be located at the end portion 221 of the deck protection component 210 to completely protect the ledger 222 from moisture. Water will collect in the concave shape of the end portion 221 and escape through the exit 219, and could be optionally directed into a gutter.

Figure 5:
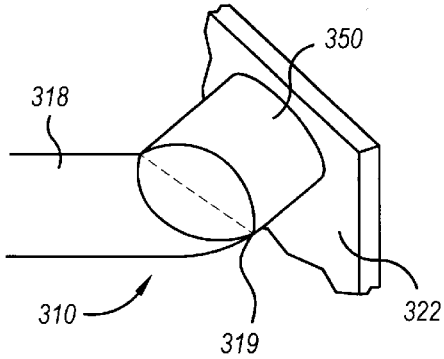
FIG. 5 is a schematic side view of the deep region of a deck protection component in a second alternative embodiment of the invention.

FIG. 5 is a schematic side view of the deep region 318 of a deck protection component 310 in a second alternative embodiment of the invention. In this embodiment, a fold line is created near the end of the deck protection component 310 and a circular cut is made about the fold line. When the deck protection system 310 is folded at the fold line, the circular cut creates an exit 319 for the water and the end piece 350 can be folded up to provide a splash guard for the ledger 322, which will at least partially prevent water from splashing onto the ledger 322. This embodiment would be relatively easy and inexpensive to manufacture.

Figure 6:
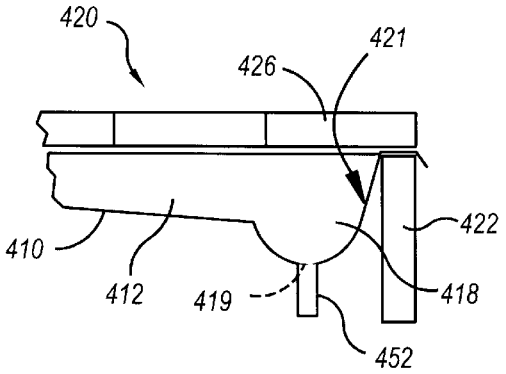
FIG. 6 is a schematic side view of the deep region of a deck protection component in a third alternative embodiment of the invention.
Figure 7:
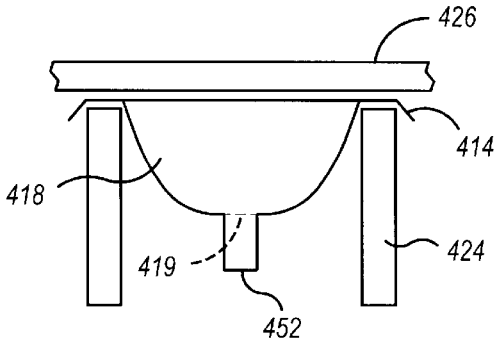
FIG. 7 is a front view of the deck protection component of FIG. 6.

FIG. 6 is a schematic side view of the deep region 418 in an end portion 421 of a deck protection component 410 in a third alternative embodiment of the invention, while FIG. 7 is a front view of the deck protection component 410 of FIG. 6. This embodiment is similar to the deck protection component 210 described in relation to FIG. 4, except that a spout 452 extends from the exit 419, which is simply a hole in the end portion 421 in the depicted embodiment. The spout 452 extends from the bottom of the end portion 421 and extends straight down from the exit 419. The spout 452 may also be carried by the deep region 418 or may be formed integrally with the deep region 452 in the end portion 421. The spout 452 may be made of a flexible material that could be easily cut, so that the purchaser could customize the spout 452 based on their own needs and deck design. For example, the purchaser could size the spout 452 to be directed into a gutter, or the purchaser could size the spout 452 so that it was not visible below the joists 424. In other embodiments, the spout 452 (and exit 419) could extend in a different direction, such as towards the ledger 422. In this embodiment, the ledge 422 may be a joist, or any other support structure. One disadvantage of directing the spout 452 towards the ledger 422 or support structure, however, is that a hole would need to be cut into the ledger 422 or support structure to permit passage of the spout 452, adding expense and complication to the process. In another alternative embodiment, a hose could be attached to the spout 452, allowing water to be directed to a location further away.

Figure 8:
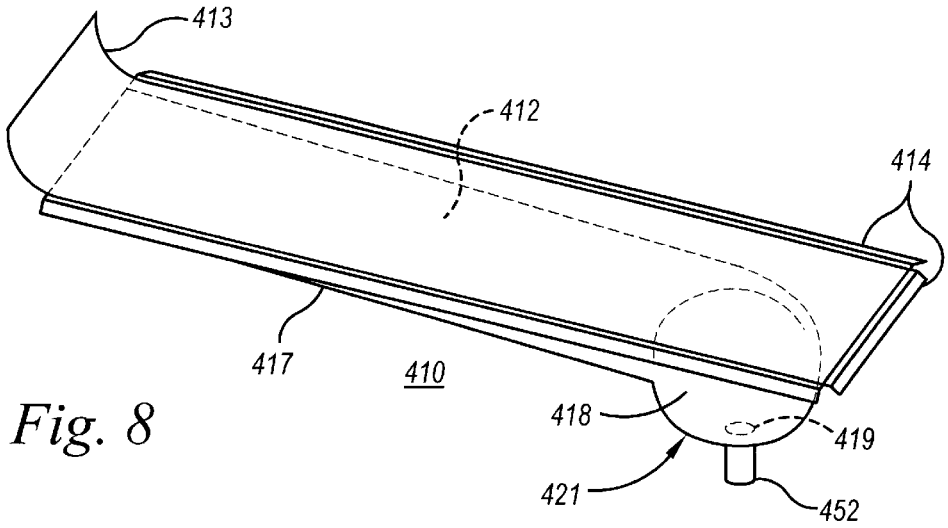
FIG. 8 is a schematic isometric view of the deck protection component of FIG. 6.

FIG. 8 is a schematic isometric view of the deck protection component 410 of FIG. 6. A flare 413 is located at the shallow region 417 of the deck protection component 410, and a flange 414 runs along both sides and the lip at the end portion 421 at the deep region 418 of the deck protection component 410. An exit 419 and spout 452 are located at the bottom of the deep region 418 of the end portion 421. One skilled in the art would recognize that virtually any combinations of the different embodiments disclosed in the application are possible.

Figure 9:
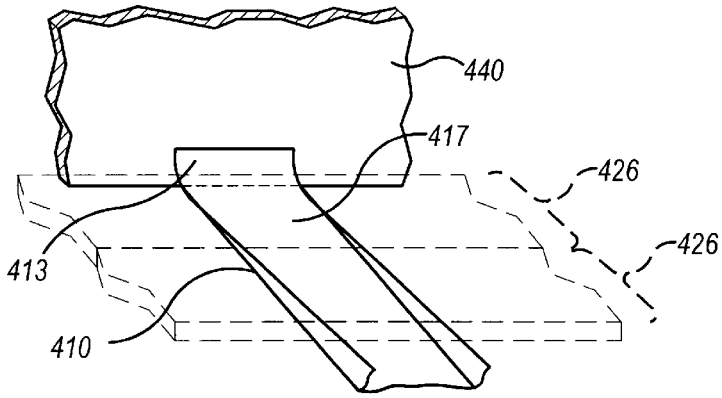
FIG. 9 is a schematic isometric view of the shallow region of the deck protection component of FIG. 6.
Figure 10:
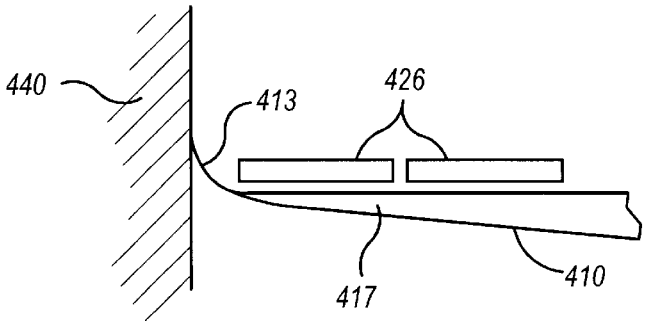
FIG. 10 is a side view of the shallow region of the deck protection component of FIG. 6.

FIG. 9 is a schematic isometric view of the shallow region 417 of the deck protection component 410 of FIG. 6, and FIG. 10 is a side view of the shallow region 417 of the deck protection component 410 of FIG. 6. In the depicted embodiment, the flare 413 of the deck protection component 410 abuts a building 440. The planks 426 are placed on top of and perpendicular to the deck protection components 410. In the depicted embodiment, the gap between the first plank 426 and the building 440 is protected from water leakage by the flare 413 located at the shallow region 417 of the deck protection component 410.

Figure 11:
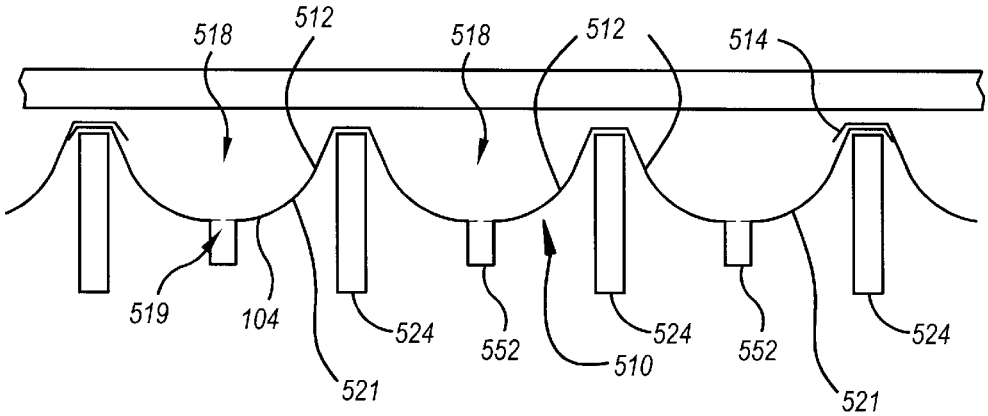
FIG. 11 is a front view of the deep regions of deck protection components in a fourth alternative embodiment of the invention.

FIG. 11 is a front view of the end portions 521 with the deep regions 518 of deck protection components 510 in a fourth alternative embodiment. In this embodiment, each deck protection component 510 spans more than two joists 524. For example, each deck protection component 510 in the depicted embodiment rests on four joists 524, so that it covers three areas between joists 524. Each deck protection component 510 would then contain multiple troughs 512, end portions 521 with the deep regions 518, etc. In this embodiment, the flanges 514 are only located at the ends of the deck protection component 510 (and on the end joists 524), so that no flanges 514 are necessary where the deck protection system 510 rests on the internal joists 524. One skilled in the art would recognize that many other alternatives are possible, including a deck protection system 510 that spans three, five, six, or any number of joists 524. One benefit of this embodiment is that some of the potential leak spots where two adjacent deck protection components 510 overlap are eliminated. Another benefit of this embodiment may be that the larger deck protection component 510 provides advantages in manufacturing, distribution, retail, etc. (i.e., a more convenient size for the retail location).

Figure 12:
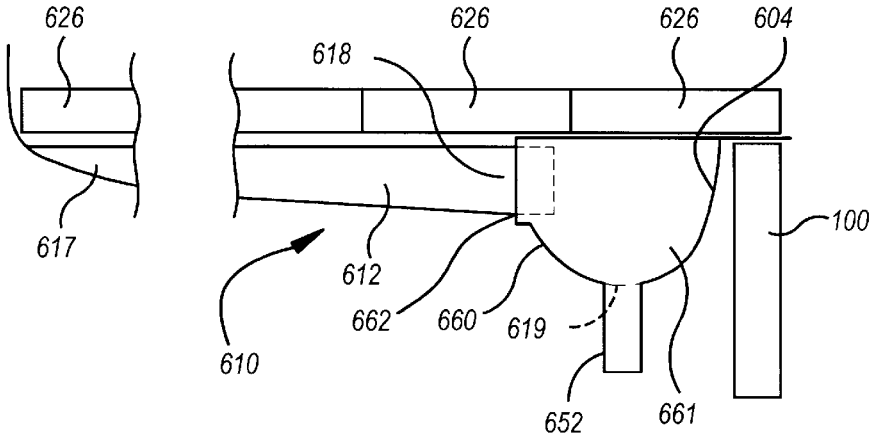
FIG. 12 is a schematic side view of the deck protection component in a fifth alternative embodiment.

FIG. 12 is a schematic side view of the deck protection system 610 in a fifth alternative embodiment. In this embodiment, the deck protection system 6104 is comprised of two or more parts. In the depicted embodiment, one or more main trough sections 612 each having a shallow region 617 and a deep region 618 are provided, and a separate end piece 660 is provided with a concave end member 661, an entrance 662, an end wall 604 opposite the entrance, an exit 619, and a spout 652. The end piece 660 may serve the functions performed by the deep region 118 of FIGS. 1–3. The one or more trough sections 612 may slide into the end piece 660 via the entrance 602, providing a substantially sealed environment for flowing water. For example, water would flow through the trough sections 612 and out the deep region 618 of the trough sections 612, where it would fall into the end piece 660 for eventual departure through the exit 619 and spout 652. The two pieces could still be easily installed by a purchaser, as a trough section 612 may just slide in to the end piece 660. In one embodiment, the trough section 612 is pushed in as far as the far side of the end piece 660, providing a secure installation where the trough section 612 will not likely back out of the end piece 660. The trough section 612 may need to be squeezed in order to fit in the end piece 660.

There are a number of advantages provided by this embodiment. First, the multiple-piece construction more easily allows injection molding to be used, as the multiple parts may be more easily injection molded by themselves instead of as one large unit. Second, this embodiment improves customization, as the trough sections 612 could be sold or cut in different lengths for different designs of decks. For example, the trough sections 612 could be sold in lengths of twenty (20) feet and cut by a purchaser to the desired length when they wished to install the deck. In another embodiment, trough sections 612 of a shorter length (e.g., four foot sections) could be sold separately, and a purchaser could just buy as many as necessary for their deck. The trough sections 612 in this embodiment could be sized in such a way so that each adjacent trough sections 612 could slide into each other. Another benefit of this embodiment is that the end piece 660 can be customized, providing the purchaser with different options. For example, purchasers could choose whether to have a spout 652, the length of the spout 652, an end piece 660 optimized for use with gutters, etc.

Figure 13:
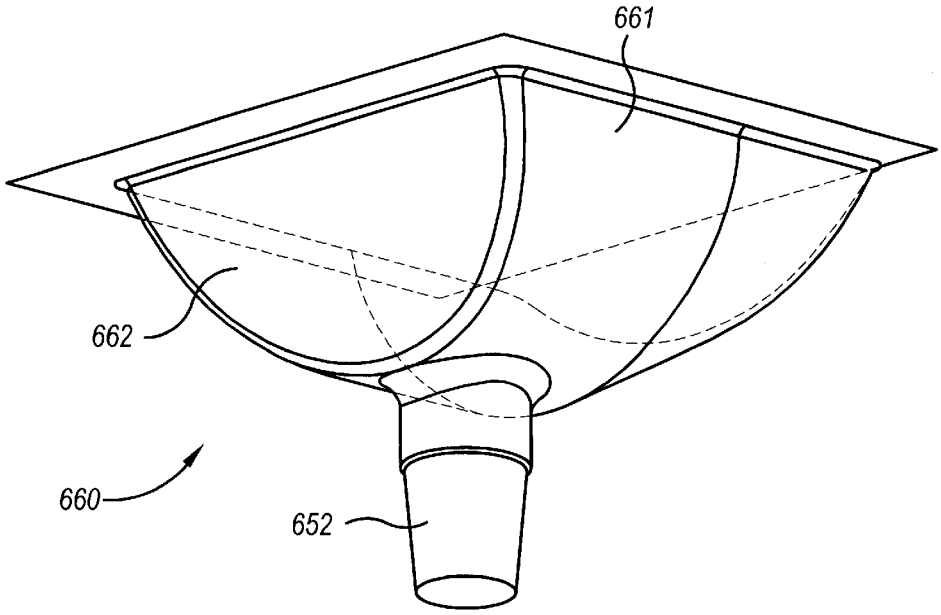
FIG. 13 illustrates an isometric schematic view of the end piece of FIG. 12.
Figure 14:
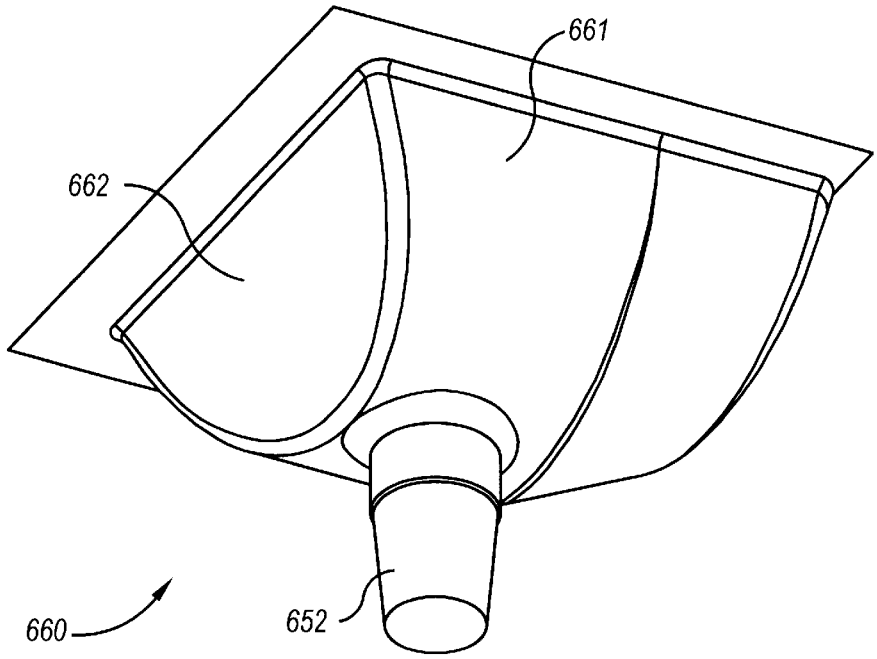
FIG. 14 illustrates an isometric view of the end piece of FIG. 12.

FIG. 13 illustrates an isometric cut-away view of the end piece 660 of FIG. 12, and FIG. 14 illustrates an isometric view of the end piece 660 of FIG. 12. The end piece 660 includes a spout 652 to direct water away from the end piece. The end piece 660 also includes an entrance hole 662 which may receive a length of the trough section 612, creating a path for water to pass from the trough section 612 to the spout 652.

Figure 15:
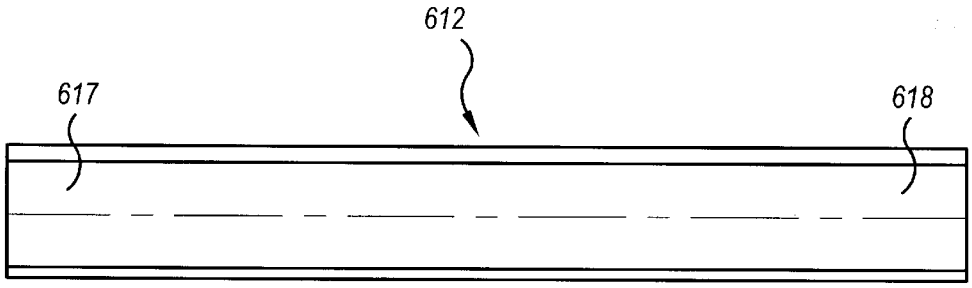
FIG. 15 is a top view of the main trough section of the deck protection system of FIG. 12.
Figure 16:
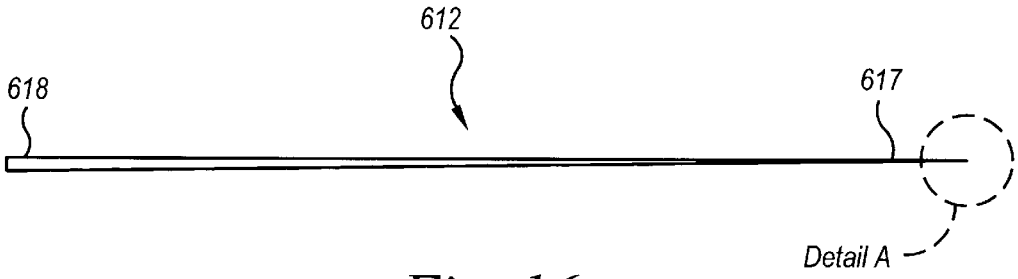
FIG. 16 is a side view of the main trough section of the deck protection system of FIG. 12.
Figure 17:
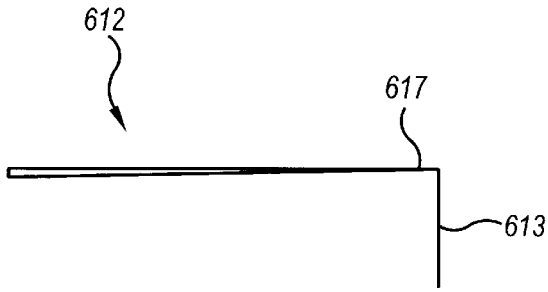
FIG. 17 is a blow-up of detail A of FIG. 16.

FIGS. 15–18 depict the main trough section of the deck protection component 610. FIG. 15 is a top view of the main trough section 612 of the deck protection system of FIG. 12. The deep region 618 is formed when the edges of the deep region 618 are squeezed together for insertion into the entrance hole 662 of the end piece 660. FIG. 16 is a side view of the main trough section 612 of the deck protection system of FIG. 12. FIG. 16 depicts the pitch or tapering from the shallow region 617 to the deep region 618. FIG. 17 is a blow-up of detail A of FIG. 16, and depicts a flare 613 that may be placed adjacent the wall of a building to increase the water resistance of the system.

Figure 18:
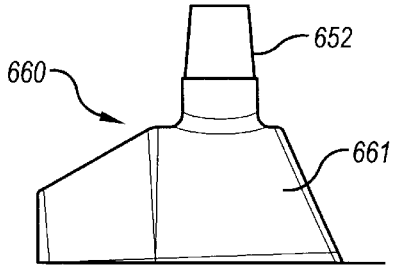
FIG. 18 is a side view of the end piece of FIG. 12.
Figure 19:
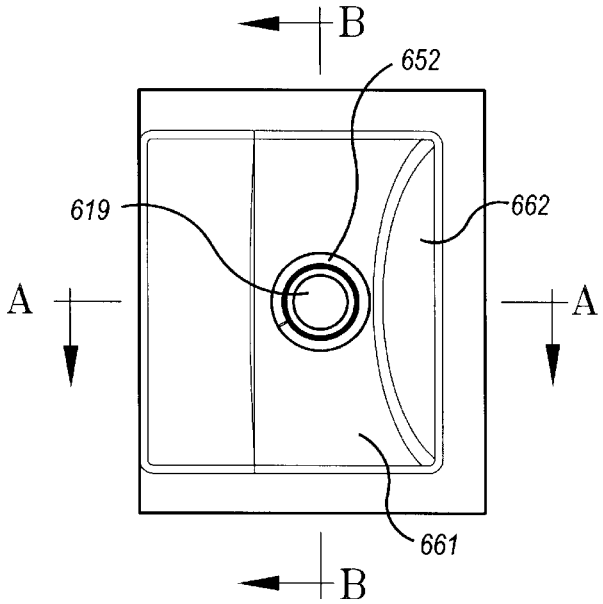
FIG. 19 is a bottom view of the end piece of FIG. 12.

FIGS. 18–21 depict the end piece 660 of FIG. 12 from different views. FIG. 18 is a side view of the end piece 660, showing the spout 652. The spout 652 is also visible from the bottom in FIG. 20, which also depicts the exit 619 seen through the length of the spout 652. The entrance hole 662 can also be seen in FIG. 19. In one embodiment, the entrance hole 662 is 13.73 inches across, while the deep region 618 of the trough section 612 that is inserted therein is 14.50 inches across. In this embodiment, the deep region 618 must be squeezed slightly together to fit the deep region 618 into the entrance hole 662. Once the deep region 618 is released, it should create a secure fit with the entrance hole 662.

Figure 20:
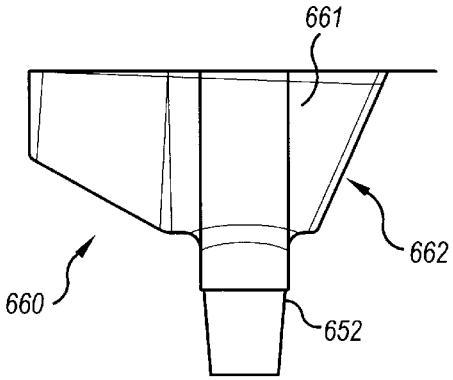
FIG. 20 is a side view of the end piece of FIG. 12 taken along section A—A of FIG. 19.
Figure 21:
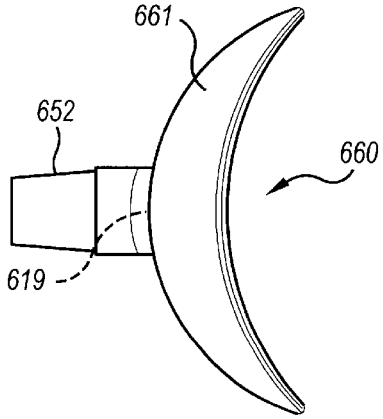
FIG. 21 is a front view of the end piece of FIG. 12 taken along section B—B of FIG. 19.

FIG. 20 is a cross-sectional view of the end piece 660 taken along section A—A of FIG. 20. In FIG. 20 it can be seen that the entrance hole 662 is located at one end of the end piece 660. The deep region 618 would be inserted into the entrance hole 662 and could be pushed as far as the opposite wall of the end piece 660. FIG. 21 is a cross-sectional view of the end piece 660 taken along section B—B of FIG. 19.

Although various embodiments of the present invention have been described in detail, it should be recognized that this is solely for purposes of illustration and example. Various changes and modifications to these illustrative embodiments may be made without departing from the spirit and scope of the present invention, which is to be limited only by the following claims. The teachings of the invention provided herein can be applied to other systems, not necessarily the deck protection system described herein. The various embodiments described herein can be combined to provide further embodiments. These and other changes can be made to the invention in light of the detailed description. Accordingly, the inventors reserve the right to add additional claims after filing the application to pursue such additional claim forms for other aspects of the invention. All of the above references and U.S. patents and applications are incorporated herein by reference.

Unless the context clearly requires otherwise, throughout the description and the claims, the words "comprise," "comprising," and the like are to be construed in an inclusive sense as opposed to an exclusive or exhaustive sense; that is to say, in a sense of "including, but not limited to." Words using the singular or plural number also include the plural or singular number respectively. Additionally, the words "herein," "hereunder," "above", "below," and words of similar import, when used in this application, shall refer to this application as a whole and not to any particular portions of this application. Use of the term "or," as used in this application with respect to a list of two or more items, shall be interpreted to cover any, all, or any combination of items in the list.

We claim:

1. A deck protection apparatus having a plurality of parallel support structures, comprising:

a body having a concave trough section, with a shallow region and a deep region, wherein water falling in the trough section flows away from the shallow region and towards the deep region;

opposing side edges located along a longitudinal length of the trough section, wherein the opposing side edges are adapted to support the body between two support structures;

an exit located near the deep region, the exit being adapted to allow passage of water therethrough; and an end piece spanning between the two support structures and being connected to the body, the end piece having an entrance in fluid communication with the exit an end wall opposite the entrance, and a spout extending in a direction outwardly from a bottom portion of the end piece, the spout being adapted to allow passage of water therethrough; and a flange located at the end piece and adapted to sit over a support structure.

2. The apparatus of claim 1 wherein the deep region is a concave shape, and wherein further the exit is located near the bottom of the concave shape.

3. The apparatus of claim 1 wherein the body is a polyethylene that is more than approximately 0.005 inch thick and less than approximately 0.030 inch thick.

4. The apparatus of claim 1 wherein the end portion has opposing edge flange adapted to supportingly engage the support structure.

5. The apparatus of claim 1 wherein each of the opposing side edges includes a flange, each flange being adapted to supportingly engage a support structure.

6. The apparatus of claim 1 wherein the deck protection apparatus has a maximum depth of less than 6 inches.

7. The apparatus of claim 1 wherein each of the opposing side edges includes a flange having a turn down adapted to extend over the support structure.

8. The apparatus of claim 1 further comprising a flare located at the shallow region, the flare being adapted to channel water towards the shallow region.

9. The apparatus of claim 1 wherein the end portion is integrally connected to the body.

10. A deck protection system comprising:

a trough having a body and two side edges, the body having a concave transverse cross section and tapering longitudinally from a shallow region to a deep region, the body being adapted to guide water to an exit at the deep region, the side edges extending longitudinally along opposed sides of the body and adapted to support the body between two spaced-apart support structures of a deck;

an end piece in fluid communication with the exit and having side portions adapted to support the end piece between the two spaced apart support structures, the end piece having a spout defining a water conduit extending in a direction outwardly from an exterior surface of the body to direct water away from the deck.

11. The deck protection system of claim 10 wherein the trough is comprised of a polyethylene material that is more than approximately 0.005 inch thick and less than approximately 0.030 inch thick.

12. The deck protection system of claim 10 wherein the end portion is integrally connected to the trough.

13. The deck protection system of claim 10 wherein the end portion has a funnel-shaped portion integrally connected to the spout.

14. A deck protection apparatus to be installed between support structures of a deck structure, the deck structure including a plurality of parallel support structures and a plurality of planks placed on a top surface of the support structures, comprising:

a body comprising:

a concave trough section, wherein the trough section has a top surface defining a water-channeling passage when the top surface is facing the planks, the trough section comprising a shallow region and a deep region, wherein water falling in the trough section flows away from the shallow region and towards the deep region; and opposing side edges located along the trough section, wherein the opposing side edges are adapted to support the trough section between two or more support structures; and an end piece, comprising:

a flange adapted to sit over a support structure;

an end member having a top surface and a bottom surface;

an exit located near a bottom of the end member, the exit being adapted to allow passage of water therethrough;

a spout in fluid communication with the exit and extending from the bottom surface of the end member, the spout being adapted to allow passage of water therethrough; and an entrance hole, the entrance hole being adapted to communicate with the deep region of the body to allow passage of water from the body to the end piece.

15. The apparatus of claim 14 wherein the end member is a concave shape, and wherein further the exit is located at the bottom of the concave shape.

16. The apparatus of claim 14 wherein the body and the end piece are made of a polyethylene material that is more than approximately 0.005 inch thick and less than approximately 0.030 inch thick.

17. The apparatus of claim 14 wherein each of the opposing side edges includes a flange, each flange being adapted to sit over a support structure.

18. The apparatus of claim 14 wherein the body and the end piece both have a maximum depth that is less than 6 inches.

19. The apparatus of claim 14 further comprising a flare located at the shallow region, the flare being adapted to channel water towards the trough section.

20. A deck system comprising:

two or more spaced-apart support structures of a deck;

one or more troughs each having a body and two opposing side edges, the bodies having a concave transverse cross section and tapering longitudinally from a shallow region to a deep region, each body being adapted to guide water to an exit passing through each body in the deep region, the side edges extending longitudinally along opposed sides of each body and adapted to support each body between two of the support structures;

an end portion connected to the deep region of one of the troughs and connected between two of the support structures, the end portion having an entrance in fluid communication with the exit of the trough, an end wall opposite the entrance, and a spout adapted to allow passage of water therethrough:

wherein each of the opposing side edges includes a flange, each flange being adapted to supportingly engage a support structure, wherein the flange on one trough overlap the flange on at least one adjacent trough; and one or more plank placed on top of the support structures, wherein the support structures also are placed on top of the flanges.

21. A deck protection apparatus to be installed between support structures of a deck structure, the deck structure including a plurality of parallel support structures and a plurality of planks placed on a top surface of the support structures, comprising:

a body having a concave trough section, wherein the trough section has a top surface defining a water-channeling passage when the top surface is facing the planks, the trough section comprising a shallow region and a deep region, wherein water falling in the trough section flows away from the shallow region and towards the deep region;

opposing side edges located along a longitudinal length of the trough section, wherein the opposing side edges are adapted to support the body between two support structures;

an exit located near the deep region, the exit being adapted to allow passage of water therethrough;

a spout connected to the body and in fluid communication with the exit, the spout extending in a direction outwardly from the bottom surface of the body, the spout being adapted to allow passage of water therethrough; and a flange located at the deep region, the deep region flange being adapted to sit over a support structure.

22. A deck protection apparatus to be installed between three or more joists of a deck structure, the deck structure including a plurality of parallel joists and a plurality of planks placed on a top surface of the support structures, comprising:

two or more bodies each having a trough section, the trough sections each comprising a shallow region and a deep region, wherein the trough sections are sloped between the two regions;

opposing side edges located along the trough sections, wherein the opposing side edges are adapted to support the bodies between the three or more joists;

wherein each of the two or more bodies are adapted to be contained between two parallel joists;

at least one exit located near the deep region of the each of the bodies, the exits being adapted to allow passage of water therethrough; and end pieces connected to the bodies between the joists, each end piece having an entrance in fluid communication with each respective exit, an end wall opposite the entrance, and a spout and-extending from a bottom portion of the end piece and body, the spouts being adapted to allow passage of water therethrough.

23. The apparatus of claim 22 wherein the bodies are comprised of a polyethylene material that is more than approximately 0.005 inch thick and less than approximately 0.030 inch thick.

24. The apparatus of claim 22 further comprising a flare located at the shallow region of each of the bodies, the flare being adapted to channel water towards the trough sections.

25. A deck protection apparatus to be installed between support structures of a deck structure, the deck structure including a plurality of parallel support structures and a plurality of planks placed on a top surface of the support structures, comprising:

a body having a concave trough section, wherein the trough section has a top surface defining a water-channeling passage when the top surface is facing the planks, the trough section comprising a shallow region and a deep region, wherein water falling in the trough section flows away from the shallow region and towards the deep region;

opposing side edges located along a longitudinal length of the trough section, wherein the opposing side edges are adapted to support the body between two support structures;

an exit located near the deep region, the exit being adapted to allow passage of water therethrough;

a spout connected to the body and in fluid communication with the exit, the spout extending in a direction outwardly from the bottom surface of the body, the spout being adapted to allow passage of water therethrough; and a flare located at the shallow region, the flare being adapted to channel water towards the shallow region.

* * * * *

UNITED STATES PATENT AND TRADEMARK OFFICE

CERTIFICATE OF CORRECTION

PATENT NO. : 6,694,686 B2
DATED : February 24, 2004
INVENTOR(S) : Kenneth W. Ready et al.

It is certified that error appears in the above-identified patent and that said Letters Patent is hereby corrected as shown below:

Column 8,
Line 52, “6104” should be -- 610 --.

Column 10,
Line 44, delete “and”;
Line 47, insert comma between “exit” and “an”;

Signed and Sealed this

Twenty-fifth Day of May, 2004

JON W. DUDAS
*Acting Director of the United States Patent and Trademark Office*